US008937557B2

(12) United States Patent
Loveland et al.

(10) Patent No.: US 8,937,557 B2
(45) Date of Patent: Jan. 20, 2015

(54) CODED WARNING SYSTEM FOR LIGHTING UNITS

(75) Inventors: Damien Loveland, Richmond (CA); Stefan Poli, Langley (CA)

(73) Assignee: Koninklijke Philips N.V., Eindhoven (NL)

( * ) Notice: Subject to any disclaimer, the term of this patent is extended or adjusted under 35 U.S.C. 154(b) by 499 days.

(21) Appl. No.: 13/146,926

(22) PCT Filed: Jan. 12, 2010

(86) PCT No.: PCT/IB2010/050107

§ 371 (c)(1), (2), (4) Date: Oct. 10, 2011

(87) PCT Pub. No.: WO2010/086758

PCT Pub. Date: Aug. 5, 2010

(65) Prior Publication Data

US 2012/0105228 A1 May 3, 2012

Related U.S. Application Data

(60) Provisional application No. 61/149,142, filed on Feb. 2, 2009.

(51) Int. Cl.

| | |
|---|---|
| ***G08B 21/00*** | (2006.01) |
| ***H05B 33/08*** | (2006.01) |
| ***H05B 37/03*** | (2006.01) |

(52) U.S. Cl.

CPC ..... *H05B 33/0803* (2013.01); *H05B 33/0884* (2013.01); *H05B 37/03* (2013.01); *H05B 33/0869* (2013.01); *H05B 33/0875* (2013.01)

USPC ..... 340/815.45; 340/458; 340/642

(58) Field of Classification Search

CPC . H05B 37/03; H05B 33/0884; H05B 33/7816

USPC ..... 340/815.45, 641, 642, 458; 345/82; 362/800

See application file for complete search history.

(56) References Cited

U.S. PATENT DOCUMENTS

| | | | |
|---|---|---|---|
| 6,016,038 | A | 1/2000 | Mueller et al. |
| 6,211,626 | B1 | 4/2001 | Lys et al. |
| 6,864,867 | B2 | 3/2005 | Biebl |
| 7,391,162 | B2 | 6/2008 | Rohlfing et al. |
| 2007/0159750 | A1 | 7/2007 | Peker et al. |
| 2008/0074872 | A1 | 3/2008 | Panotopoulos |

FOREIGN PATENT DOCUMENTS

| | | | |
|---|---|---|---|
| WO | 2007011852 | A2 | 1/2007 |
| WO | 2008061301 | A1 | 5/2008 |

*Primary Examiner* — Jeffery Hofsass

(74) *Attorney, Agent, or Firm* — Meenakshy Chakravorty

(57) ABSTRACT

The application discloses a method and apparatus for providing a desired warning signal for a lighting unit. A coded warning system is provided employing a detection module (320) and a signal generating module (330), wherein the detection module is configured to obtain information regarding the detection of one or more operating parameters of the lighting unit and the signal generating module generates a desired warning signal (331) selected from a plurality of warning signals, upon determination that one or more of the operating parameters are abnormal operating parameters. Each warning signal of the plurality of warning signals is indicative of a specific abnormal operating parameter or a known combination of specific abnormal operating parameters.

18 Claims, 9 Drawing Sheets

CODED WARNING SYSTEM FOR LIGHTING UNITS

TECHNICAL FIELD

The present invention is directed generally to lighting units. More particularly, various inventive methods and apparatus disclosed herein relate to lighting units configured to communicate abnormalities in their operation via lighting effects and coded warning systems therefor.

BACKGROUND

Digital lighting technologies, i.e. illumination based on semiconductor light sources, such as light-emitting diodes (LEDs), offer a viable alternative to traditional fluorescent, HID, and incandescent lamps. Functional advantages and benefits of LEDs include high energy conversion and optical efficiency, durability, lower operating costs, and many others. Recent advances in LED technology have provided efficient and robust full-spectrum lighting sources that enable a variety of lighting effects in many applications. Some of the fixtures embodying these sources feature a lighting module, including one or more LEDs capable of producing different colors, e.g. red, green, and blue, as well as a processor for independently controlling the output of the LEDs in order to generate a variety of colors and color-changing lighting effects, for example, as discussed in detail in U.S. Pat. Nos. 6,016,038 and 6,211,626.

Lighting units of all types have an expected lifetime, and sooner or later will fail. Sometimes the failure is sudden (e.g. incandescent lamps), or it is gradual (e.g. fluorescent lights or LED-based light sources). Failed lighting units are often a problem for numerous reasons. The lack of sufficient illumination could result in a safety hazard, an unsightly illumination zone or a spoiled shop display which may deter potential customers.

A failed lighting unit needs an appropriate remedial action, i.e., either to be replaced or fixed. But often, a spare lighting unit is not readily available, or it is inconvenient to replace or fix the lighting unit right away. This can result in no illumination for an undesirably extended period of time. This scenario can be more likely for LED-based lighting units, as users may not keep spares on account of their higher costs and longer lifetimes. This problem may be overcome by providing a warning signal indicating that remedial action is required imminently.

Faults in the operation of a lighting unit include, but are not limited to, an excessive temperature, a low light output, a high drive current or voltage, a low fan speed, a high current for driving a fan, or an excessive change in temperature, or rate of change of temperature. Other faults include failure of sensors and/or hardware, software bugs and "divide by zero" errors in firmware, or other faults readily known to skilled artisans.

In many cases, a lighting unit fails as a result of the malfunction or failure of one or a few of its component modules. In such a scenario, an appropriate remedial action is to replace or fix the specific failed component module(s), rather than replace the entire lighting unit. Some conventional lighting systems employ means for indicating imminent failure. However, as these systems are typically configured to only indicate a general failure of the entire lighting unit, they are poorly suited to ascertain an appropriate remedial action, without further fault tracing.

For example, the COLORBLAST POWERCORE luminaire available from Philips Color Kinetics (Burlington, Mass.) is configured to output a dull red light in the case of overheating. However, there is no indication as to the cause of overheating, whether it is due to internal malfunction, poor installation, end of lifetime or a high ambient temperature. Therefore, remedial options are to replace the entire lighting unit outright or to attempt to determine a cause for the overheating via active fault tracing on the lighting unit.

As a further example, lighting units, particularly those recessed in ceilings, generally dissipate waste heat via conduction to the surroundings. Often, ceilings are insulated and therefore impede the loss of heat. Excessive temperatures may reduce the lifetime of light sources and a fan or other kind of active cooling system is typically incorporated in the lighting unit to improve heat dissipation. The lifetime of a fan may however, be less than the lifetime of the light sources. The fan's performance may deteriorate due to dust build up, and may only need removal and cleaning, or other maintenance, instead of replacement. Identical lighting units may suffer vastly different dust buildups depending on the environment they are installed in. If a warning signal only indicates an imminent general failure of the lighting unit, it is likely that a lighting unit with functional components is unnecessarily completely replaced, considering, for example, that complete replacement may be more cost effective than having a technician performing diagnostic testing.

Thus, there is a need in the art to provide systems and methods for providing warning signals for a lighting unit that will visually indicate to a user the specific nature of a fault, allowing for determination of an appropriate remedial action. It is also desirable to communicate or display these warning signals to the user in a cost-efficient and effective manner.

SUMMARY

The present disclosure is directed to inventive methods and apparatus for the provisioning of a desired warning signal indicative of a specific abnormal operating parameter or a known combination of specific abnormal operating parameters of the lighting unit.

Generally, in one aspect, a coded warning system is provided for a lighting unit comprising one or more light sources configured to emit light. The coded warning system includes a detection module configured to obtain information regarding the detection of one or more operating parameters of said lighting unit; and a signal generating module configured to generate a desired warning signal selected from a plurality of warning signals, upon determination that one or more of the operating parameters are abnormal operating parameters; wherein each warning signal of the plurality of warning signals is indicative of a specific abnormal operating parameter or a known combination of specific abnormal operating parameters.

In some embodiments, an operating parameter is determined to be an abnormal operating parameter when it falls outside a pre-determined range for the operating parameter. In other embodiments, an operating parameter is determined to be an abnormal operating parameter only when it falls outside a pre-determined range for the operating parameter a pre-determined number of instances.

In various embodiments, the desired warning signal is communicated to a user via a warning indicator corresponding to said warning signal. For example, the warning indicator can be a lighting effect generated by at least one of said light sources, such as one or more blinks; one or more momentary intensity drops; a temporary color change; a series of color changes; and variations of light output based on different time scales, time durations, intensities and/or colors.

In some embodiments, the desired warning signal is generated at substantially switch-on or substantially switch-off of the lighting unit and the one or more operating parameters are detected at substantially switch-on or substantially switch-off of the lighting unit.

In some embodiments, the one or more operating parameters are detected when the lighting unit is switched on, and the coded warning system further includes an electronic memory for recording information regarding the one or more operating parameters detected, and the information is used, at least in part, for generating said desired warning signal.

Examples of operating parameters include temperature, light output, drive current, drive voltage, change in temperature, rate of change of temperature, and time of operation of the light sources; speed and drive current of a fan used for active cooling of the lighting unit, ambient temperature, sensor failure, hardware failure or problems, firmware bugs, divide by zero errors in firmware, and faulty string in a multiple string lighting unit.

In general, in another aspect, the invention contemplates a lighting unit configured to signal abnormalities in its operation to a user via a lighting effect. The lighting unit includes one or more light sources configured to emit light; a controller configured to drive at least one of the one or more light sources; a detection module configured to obtain information regarding the detection of one or more operating parameters of the lighting unit; and a signal generating module configured to generate a desired warning signal selected from a plurality of warning signals, upon determination that one or more of the operating parameters are abnormal operating parameters; wherein each warning signal of the plurality of warning signals is indicative of a specific abnormal operating parameter or a known combination of specific abnormal operating parameters and wherein said controller is further configured to drive at least one of said light sources in response to said desired warning signal to generate the lighting effect corresponding thereto.

In one embodiment, the lighting unit is configured for mounting in a cylindrical recess, and further includes a heat sink operatively associated with the controller; a removable fan configured to draw air proximal to the heat sink to remove waste heat there-from; and baffles operatively attached to an external side of a housing of said lighting unit for enhanced circulation of air and thus, removal of said waste heat. In one version of the embodiment, the gap between the baffles and the cylindrical recess is significantly smaller than the gap between the rim of the lighting unit and the sidewall of the cylindrical recess.

In still another aspect, the invention focuses on a method of signaling abnormalities in the operation of a lighting unit comprising one or more light sources configured to emit light. The method includes obtaining information regarding the detection of one or more operating parameters of said lighting unit; and generating a desired warning signal selected from a plurality of warning signals, upon determination that one or more of the operating parameters are abnormal operating parameters; wherein each warning signal of the plurality of warning signals is indicative of a specific abnormal operating parameter or a known combination of specific abnormal operating parameters. In various embodiments, the method further includes generating a lighting effect by said one or more light sources corresponding to said desired warning signal.

As used herein for purposes of the present disclosure, the term "LED" should be understood to include any electroluminescent diode or other type of carrier injection/junction-based system that is capable of generating radiation in response to an electric signal. Thus, the term LED includes, but is not limited to, various semiconductor-based structures that emit light in response to current, light emitting polymers, organic light emitting diodes (OLEDs), electroluminescent strips, and the like. In particular, the term LED refers to light emitting diodes of all types (including semi-conductor and organic light emitting diodes) that may be configured to generate radiation in one or more of the infrared spectrum, ultraviolet spectrum, and various portions of the visible spectrum (generally including radiation wavelengths from approximately 400 nanometers to approximately 700 nanometers). Some examples of LEDs include, but are not limited to, various types of infrared LEDs, ultraviolet LEDs, red LEDs, blue LEDs, green LEDs, yellow LEDs, amber LEDs, orange LEDs, and white LEDs (discussed further below). It also should be appreciated that LEDs may be configured and/or controlled to generate radiation having various bandwidths (e.g., full widths at half maximum, or FWHM) for a given spectrum (e.g., narrow bandwidth, broad bandwidth), and a variety of dominant wavelengths within a given general color categorization.

For example, one implementation of an LED configured to generate essentially white light (e.g., a white LED) may include a number of dies which respectively emit different spectra of electroluminescence that, in combination, mix to form essentially white light. In another implementation, a white light LED may be associated with a phosphor material that converts electroluminescence having a first spectrum to a different second spectrum. In one example of this implementation, electroluminescence having a relatively short wavelength and narrow bandwidth spectrum "pumps" the phosphor material, which in turn radiates longer wavelength radiation having a somewhat broader spectrum.

It should also be understood that the term LED does not limit the physical and/or electrical package type of an LED. For example, as discussed above, an LED may refer to a single light emitting device having multiple dies that are configured to respectively emit different spectra of radiation (e.g., that may or may not be individually controllable). Also, an LED may be associated with a phosphor that is considered as an integral part of the LED (e.g., some types of white LEDs). In general, the term LED may refer to packaged LEDs, non-packaged LEDs, surface mount LEDs, chip-on-board LEDs, T-package mount LEDs, radial package LEDs, power package LEDs, LEDs including some type of encasement and/or optical element (e.g., a diffusing lens), etc.

The term "light source" should be understood to refer to any one or more of a variety of radiation sources, including, but not limited to, LED-based sources (including one or more LEDs as defined above), incandescent sources (e.g., filament lamps, halogen lamps), fluorescent sources, phosphorescent sources, high-intensity discharge sources (e.g., sodium vapor, mercury vapor, and metal halide lamps), lasers, other types of electroluminescent sources, pyro-luminescent sources (e.g., flames), candle-luminescent sources (e.g., gas mantles, carbon arc radiation sources), photo-luminescent sources (e.g., gaseous discharge sources), cathode luminescent sources using electronic satiation, galvano-luminescent sources, crystallo-luminescent sources, kine-luminescent sources, thermo-luminescent sources, triboluminescent sources, sonoluminescent sources, radioluminescent sources, and luminescent polymers.

A given light source may be configured to generate electromagnetic radiation within the visible spectrum, outside the visible spectrum, or a combination of both. Hence, the terms "light" and "radiation" are used interchangeably herein. Additionally, a light source may include as an integral component one or more filters (e.g., color filters), lenses, or other optical components. Also, it should be understood that light sources may be configured for a variety of applications, including, but not limited to, indication, display, and/or illumination. An "illumination source" is a light source that is particularly configured to generate radiation having a sufficient intensity to effectively illuminate an interior or exterior space. In this context, "sufficient intensity" refers to sufficient radiant power in the visible spectrum generated in the space or environment (the unit "lumens" often is employed to represent the total light output from a light source in all directions, in terms of radiant power or "luminous flux") to provide ambient illumination (i.e., light that may be perceived indirectly and that may be, for example, reflected off of one or more of a variety of intervening surfaces before being perceived in whole or in part).

The term "spectrum" should be understood to refer to any one or more frequencies (or wavelengths) of radiation produced by one or more light sources. Accordingly, the term "spectrum" refers to frequencies (or wavelengths) not only in the visible range, but also frequencies (or wavelengths) in the infrared, ultraviolet, and other areas of the overall electromagnetic spectrum. Also, a given spectrum may have a relatively narrow bandwidth (e.g., a FWHM having essentially few frequency or wavelength components) or a relatively wide bandwidth (several frequency or wavelength components having various relative strengths). It should also be appreciated that a given spectrum may be the result of a mixing of two or more other spectra (e.g., mixing radiation respectively emitted from multiple light sources).

For purposes of this disclosure, the term "color" is used interchangeably with the term "spectrum." However, the term "color" generally is used to refer primarily to a property of radiation that is perceivable by an observer (although this usage is not intended to limit the scope of this term). Accordingly, the terms "different colors" implicitly refer to multiple spectra having different wavelength components and/or bandwidths. It also should be appreciated that the term "color" may be used in connection with both white and non-white light.

The term "color temperature" generally is used herein in connection with white light, although this usage is not intended to limit the scope of this term. Color temperature essentially refers to a particular color content or shade (e.g., reddish, bluish) of white light. The color temperature of a given radiation sample conventionally is characterized according to the temperature in degrees Kelvin (K) of a black body radiator that radiates essentially the same spectrum as the radiation sample in question. Black body radiator color temperatures generally fall within a range of from approximately 700 degrees K (typically considered the first visible to the human eye) to over 10,000 degrees K; white light generally is perceived at color temperatures above 1500-2000 degrees K.

The term "lighting fixture" is used herein to refer to an implementation or arrangement of one or more lighting units in a particular form factor, assembly, or package. The term "lighting unit" is used herein to refer to an apparatus including one or more light sources of same or different types. A given lighting unit may have any one of a variety of mounting arrangements for the light source(s), enclosure/housing arrangements and shapes, and/or electrical and mechanical connection configurations. Additionally, a given lighting unit optionally may be associated with (e.g., include, be coupled to and/or packaged together with) various other components (e.g., control circuitry) relating to the operation of the light source(s). An "LED-based lighting unit" refers to a lighting unit that includes one or more LED-based light sources as discussed above, alone or in combination with other non LED-based light sources. A "multi-channel" lighting unit refers to an LED-based or non LED-based lighting unit that includes at least two light sources configured to respectively generate different spectrums of radiation, wherein each different source spectrum may be referred to as a "channel" of the multi-channel lighting unit.

The term "controller" is used herein generally to describe various apparatus relating to the operation of one or more light sources. A controller can be implemented in numerous ways (e.g., such as with dedicated hardware) to perform various functions discussed herein. A "processor" is one example of a controller which employs one or more microprocessors that may be programmed using software (e.g., microcode) to perform various functions discussed herein. A controller may be implemented with or without employing a processor, and also may be implemented as a combination of dedicated hardware to perform some functions and a processor (e.g., one or more programmed microprocessors and associated circuitry) to perform other functions. Examples of controller components that may be employed in various embodiments of the present disclosure include, but are not limited to, conventional microprocessors, application specific integrated circuits (ASICs), and field-programmable gate arrays (FPGAs).

In one network implementation, one or more devices coupled to a network may serve as a controller for one or more other devices coupled to the network (e.g., in a master/slave relationship). In another implementation, a networked environment may include one or more dedicated controllers that are configured to control one or more of the devices coupled to the network. Generally, multiple devices coupled to the network each may have access to data that is present on the communications medium or media; however, a given device may be "addressable" in that it is configured to selectively exchange data with (i.e., receive data from and/or transmit data to) the network, based, for example, on one or more particular identifiers (e.g., "addresses") assigned to it.

The term "network" as used herein refers to any interconnection of two or more devices (including controllers or processors) that facilitates the transport of information (e.g. for device control, data storage, data exchange, etc.) between any two or more devices and/or among multiple devices coupled to the network. As should be readily appreciated, various implementations of networks suitable for interconnecting multiple devices may include any of a variety of network topologies and employ any of a variety of communication protocols. Additionally, in various networks according to the present disclosure, any one connection between two devices may represent a dedicated connection between the two systems, or alternatively a non-dedicated connection. In addition to carrying information intended for the two devices, such a non-dedicated connection may carry information not necessarily intended for either of the two devices (e.g., an open network connection). Furthermore, it should be readily appreciated that various networks of devices as discussed herein may employ one or more wireless, wire/cable, and/or fiber optic links to facilitate information transport throughout the network.

It should be appreciated that all combinations of the foregoing concepts and additional concepts discussed in greater detail below (provided such concepts are not mutually inconsistent) are contemplated as being part of the inventive subject matter disclosed herein. In particular, all combinations of claimed subject matter appearing at the end of this disclosure are contemplated as being part of the inventive subject matter disclosed herein. It should also be appreciated that terminology explicitly employed herein that also may appear in any disclosure incorporated by reference should be accorded a meaning most consistent with the particular concepts disclosed herein.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention.

DETAILED DESCRIPTION

Lighting units of all types sooner or later will fail, and therefore need an appropriate remedial action, i.e., either to be replaced or repaired. Conventional lighting units often provide early warning signals which denote imminent failure; however, they do not indicate the specific abnormality in the operation of the lighting unit. Therefore, a user has to either replace the entire lighting unit with potentially significant cost implications, or further resort to time-consuming fault tracing techniques to determine the specific abnormality.

In that regard, Applicants have recognized and appreciated that it would be beneficial to provide a method and system that provides a desired warning signal that is indicative of a specific abnormal operating parameter or a known combination of specific abnormal operating parameters of a lighting unit. Therefore, the warning signal that is presented defines the problem with the lighting unit. Applicants have further recognized and appreciated that it would be useful to communicate such warning signal to a user via a visual indicator, e.g. a lighting effect, generated by the lighting unit itself, rather than by a separate indicator.

In view of the foregoing, various embodiments and implementations of the invention are directed to a coded warning system for a lighting unit. The coded warning system includes a detection module for obtaining one or more operating parameters of the lighting unit, and a signal generating module for generation of a warning signal that can indicate the specific operating parameter that is determined to be abnormal or the known combination of specific operating parameters that are determined to be abnormal.

Various embodiments and implementations of the invention are also directed to a lighting unit that is configured to obtain information regarding the detection of various operating parameters and to generate a warning signal to indicate if there is a determination of abnormality in the operating parameters. The warning signal that is generated is indicative of a specific operating parameter that is determined to be abnormal or a known combination of specific operating parameters that are determined to be abnormal. A detection module is used for obtaining information regarding the detection of the various operating parameters, and a signal generating module is used for generating the warning signal.

Figure 1A:
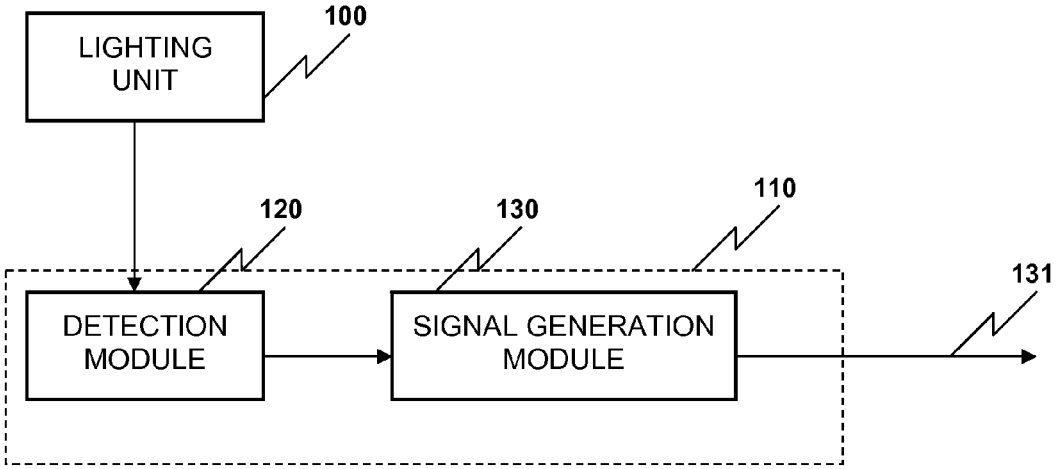
FIG. 1A-1B illustrates a schematic of a coded warning system including a detection module and signal generating module, in accordance with embodiments of the invention, which is either part of or in operative association with a lighting unit.
Figure 1B:
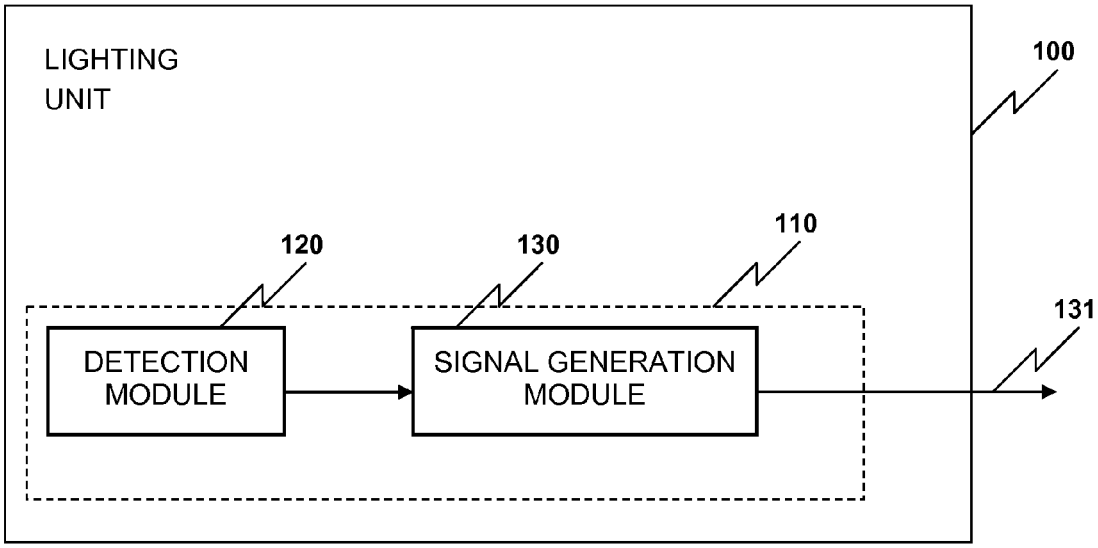

Referring to FIGS. 1A-1B, in various embodiments of the invention, a coded warning system 110 is in operative association with (FIG. 1A) or part of (FIG. 1B) a lighting unit 100. Information regarding the detection of various operating parameters of the lighting unit 100 is obtained by the detection module 120 and a desired warning signal 131 is generated by a signal generating module 130, if it is determined that one or more of the operating parameters are abnormal operating parameters.

In some embodiments, the coded warning system is configured for real-time processing, for example, by using hardwired circuits for the detection module and the signal generating module. In embodiments of the invention, the coded warning system uses a memory-based configuration, which allows for storage of information relating to the detected operating parameters. The stored information, at least in part, is used to generate a desired warning signal, if one or more of the operating parameters are abnormal.

Lighting Unit

The lighting unit includes one or more light sources configured to emit light, wherein the light sources may be of the same or different types, and may be one or more of a variety of radiation sources. For example, a light source may include one or more LEDs or may include one or more incandescent sources, such as filament lamps or halogen lamps or other light source configuration as would be readily understood by skilled artisans. The light emitted by the light sources may fall within the visible region of the electromagnetic spectrum, outside the visible spectrum, or a combination thereof. In some embodiments, the lighting unit includes arrays of light sources, each array having a plurality of light sources emitting light of the same or different wavelength ranges. The lighting unit may utilize means for combining light (e.g. mixing optics) of different wavelength ranges to generate light of a specific chromaticity, for instance white light.

The lighting unit optionally also includes means for cooling. In some embodiments, the lighting unit includes an active cooling means, such as a fan or Peltier device. In embodiments, the light sources are in thermal contact with one or more heat sinks, heat pipes, thermosyphons or other thermal management systems, which may be separate or common to the light sources.

The lighting unit includes a controller that controls the operation of at least part of the lighting unit. In some embodiments and referring to FIG. 2A, the controller 205 controls at least one of the light source(s) 202. In some embodiments and referring to FIG. 4B, the controller 705 controls the operation of the light source(s) 702 and the active cooling means 704.

The controller may be operatively associated with one or more current drivers that are configured to supply current to the light sources, and thus control the light output thereof. The current drivers may be operated independently, interdependently and/or dependently. The current drivers may optionally utilize modulation techniques to modulate the driving current to the light source(s). Modulation techniques that can be used include pulse width modulation (PWM), pulse code modulation (PCM), or other digital or analog formats known in the art.

The controller may be implemented in a variety of ways. In some embodiments, the controller is implemented using dedicated hardware. In some embodiments, the controller utilizes a processor, as defined above, which may be programmable. In embodiments, the controller uses a combination of dedicated hardware and processors. Examples of components that may be employed within the controller in various embodiments of the present disclosure include, but are not limited to, conventional microprocessors, application specific integrated circuits (ASICs), and field-programmable gate arrays (FPGAs). The controller may optionally utilize one or more types of storage media, such as memory, as defined above.

The controller may be configured to implement a feedback and/or feed-forward control scheme, and may be operatively associated with one or more sensors that detect one or more operating parameters of the lighting unit. In some embodiments, the controller includes one or more sensors e.g. voltage sensors, temperature sensors, current sensors, optical sensors, and/or other sensors as would be readily understood by a worker skilled in the art. For example, a sensor may be used to measure the light output of the lighting unit, and adjust the drive currents of the light source(s) to ensure that the light output is maintained at substantially a constant chromaticity or intensity.

In some embodiments, current sensors are coupled to the output of current drivers to measure instantaneous forward current supplied to the light source(s). Examples of current sensors include but are not limited to a fixed resistor, a variable resistor, an inductor, a Hall effect current sensor, or other element which has a known voltage-current relationship and can provide a measurement of the current flowing through the load, for example an array of one or more light sources, based on a measured voltage signal.

In some embodiments, voltage sensors are coupled to the output of current drivers to measure the instantaneous forward voltage of light source(s). In some embodiments, the lighting unit includes one or more optical sensors that may be designed to sense the light in a narrow wavelength range (i.e., narrow-band sensors) or alternately, sense light in a broad wavelength range (i.e., broad-band sensors). Examples of optical sensors include photodiodes, phototransistors, photosensor integrated circuits (ICs), unenergized LEDs, and the like. For example, an optical sensor may be designed to be sensitive only to light in the blue wavelength range. An optical sensor may optionally, be operatively associated with one or more optical filters that ensure that the light incident on the optical sensor is limited to a narrow wavelength range of choice. For example, when an optical sensor is desired to capture only a specific desired wavelength range, which may be a subset of the wavelength range to which the optical sensor is responsive, an optical filter associated with that optical sensor can limit the incident wavelengths to the desired wavelength range. Optical filters that can be used include thin film interference, dyed plastic, dyed glass or the like.

In some embodiments, one or more temperature sensors are in thermal contact with the light source(s) (e.g. through one or more heat sinks) and serve to measure the temperature thereof. Temperature sensors can be implemented using a thermistor, a thermocouple, measurement of the forward voltage of a light source, integrated temperature sensing circuits, or any other device or method that is responsive to variations in temperature as contemplated by those skilled in the art.

Figure 2A:
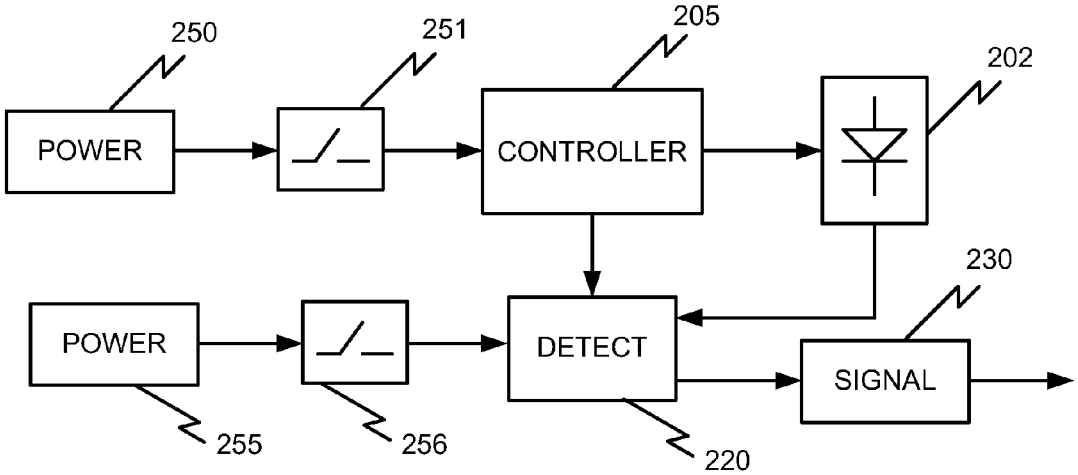
FIGS. 2A-B illustrate lighting units comprising one or more light source(s), a controller and a coded warning system, according to embodiments of the invention.

The lighting unit may be powered by various means. The lighting unit may share a source of power with other lighting units and/or other systems, or may have a dedicated source of power. Referring to FIG. 2A, in some embodiments, the source of power 250 is external to the lighting unit, and accessed through one or more switching elements 251 that may be within the lighting unit. Alternately, the power is at least partially supplied by sources of power that may form a part of the lighting unit (e.g. a battery). In embodiments and referring to FIG. 2B, the lighting unit shares a source of power 350 with a coded warning system incorporated therein, using a common switch 351. In some embodiments and referring to FIG. 2A, the lighting unit and an operatively associated coded warning system comprising a detection module 220 and signal generating module 330, access dedicated sources of power 250, 255 through dedicated switching elements 251, 256 respectively.

Figure 2B:
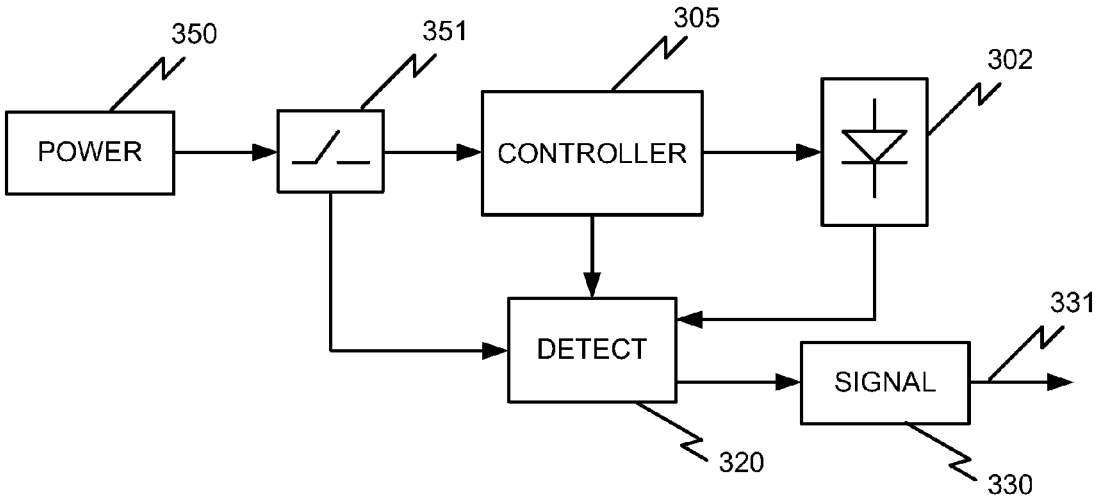

Referring to FIG. 2B, a lighting unit incorporating a coded warning system is shown, in accordance with some embodiments of the invention. A power source 350 such as a mains power supply is connected to the lighting unit via a switch 351, and provides power for the coded warning system, controller 305 and the light source(s) 302. The switch may be a wall switch or be incorporated in the lighting unit. When the switch is switched on, the controller is powered up and starts to power the one or more light sources, which may be of the same or different wavelengths. The detection module 320 detects various operating parameters of the lighting unit at switch on. When one or more operating parameters are determined to be abnormal, the signal generating module 330 generates the desired warning signal 331.

The lighting unit may utilize a modular design, which allows for easier replacement and/or maintenance of the component modules. For example, the light source(s) and the cooling means may be separate, removable modules. Various modules that may constitute a lighting unit include but are not limited to an optical module, a control module, a heating module, and other modules as would be readily known to a worker skilled in the art. Depending on the configuration of the lighting unit, one or more of such modules may be combined or be separate.

The coded warning system includes a detection module and a signal generating module. Optionally, the coded warning system further includes a memory for storage of information relating to the detected operating parameters. These modules are discussed in greater detail in the following sections.

Detection Module

The detection module is configured to obtain information regarding the detection of one or more operating parameters of a lighting unit. The detected operating parameters may include temperature, light output, drive current, drive voltage, change in temperature, rate of change of temperature, and time of operation of said light source(s); speed and drive current of a fan used for active cooling of the light source(s). Depending on the complexity of the lighting unit, other operating parameters can be detected including, but not limited to, ambient temperature, sensor failure, hardware failure or problems, firmware bugs, divide by zero errors in firmware, and a faulty string of light sources in a multiple string lighting unit. A worker skilled in the art will readily know that the detection module may be configured to obtain information regarding the detection of other operating parameters of the lighting unit.

The detection module is operatively coupled with one or more sensors that are designed and configured to detect one or more operating parameters of the lighting unit. The sensors used may be voltage sensors, temperature sensors, current sensors, optical sensors, and/or other sensors as would be readily understood by a worker skilled in the art. Information regarding the detection of the operating parameters, is obtained by the detection module.

In some embodiments, the detection module obtains information regarding instantaneous forward current supplied to the light source(s), from current sensors that are coupled to the output of current drivers operatively coupled to the light source(s). Examples of suitable current sensors include but are not limited to a fixed resistor, a variable resistor, an inductor, a Hall effect current sensor, or other element which has a known voltage-current relationship and can provide a measurement of the current flowing through the load, for example an array of one or more light sources, based on a measured voltage signal.

In some embodiments, voltage sensors are coupled to the output of current drivers to measure the instantaneous forward voltage of light source(s).

In some embodiments, optical sensors are used to detect the light output from the lighting unit. Examples of optical sensors include photodiodes, phototransistors, photosensor integrated circuits (ICs), unenergized LEDs, and the like. An optical sensor may detect the light only in a narrow wavelength range of choice, for example, by the use of operatively associated optical filter(s).

In some embodiments, one or more temperature sensors are in thermal contact with the light source(s) (e.g. through one or more heat sinks) and serve to measure the temperature thereof. Temperature sensors can be implemented using a thermistor, a thermocouple, measurement of the forward voltage of a light source, integrated temperature sensing circuits, or any other device or method that is responsive to variations in temperature as contemplated by those skilled in the art.

In some embodiments, the detection module includes sensors for sensing each operating parameter of the lighting unit that is to be detected. In one embodiment, one or more operating parameters of the lighting unit are detected by sensors that are a component of the lighting unit. For example, the detection module may be operatively coupled to the lighting unit such that the detection module can extract data or signals that are captured by sensors of the lighting unit.

In some embodiments, one or more operating parameters may be common to multiple lighting units, and may therefore be detected by common sensors. For example, a single sensor may be used to detect ambient temperature, in lighting configurations where it is reasonable to assume that the ambient temperature is constant across multiple lighting units. The common sensor may be part of a different system. For example, a sensor to measure ambient temperature may be part of the thermostat system for the building.

Information relating to operating parameters detected by sensors external to the coded warning system and/or the lighting unit, may be transmitted to the detection module, the signal generating module, and/or the memory of the coded warning system; and/or the controller, and/or memory of the lighting unit. The external sensors may be communicatively linked to the coded warning system and/or the lighting unit using one or more hardwired communication links, or one or more wireless links (e.g. Bluetooth, WiFi), or other communication links as would be readily known to a worker skilled in the art.

In some embodiments, at least one of the operating parameters is detected when said lighting unit is switched on, for example. Furthermore, one or more of the operating parameters may be monitored on a continual basis or on a periodic basis.

In some embodiments, the detection of the operating parameters occurs either at switch-on or switch-off of the lighting unit. Detection of operating parameters at switch-on or switch-off of the lighting unit also provides information regarding the operation of the lighting unit under transient conditions. A worker skilled in the art will readily understand that detection of operating parameters in transient conditions may give useful information regarding potential failure of the lighting unit that may not be obtained only by detection of operating parameters during steady-state conditions (e.g. information regarding power surges which may occur when a lighting unit is switched on).

In embodiments, the detection module may be configured to obtain one or more derived operating parameters from the one or more detected operating parameters. For example, the junction temperature of a LED used as a light source may be derived from the detection of the forward voltage of the LED.

In some embodiments, the derived operating parameters may be obtained by real-time processing; for example, using dedicated circuitry. The dedicated circuitry may for example, be an integrator circuit, a comparator circuit, or the like; and may receive signals regarding one or more detected operating parameters. In one embodiment, an integrator circuit provides a derived operating parameter based on the integration of a single operating parameter over time. In one embodiment, a comparator circuit is be used to provide a derived operating parameter based on the comparison of two signals, for example, a temperature measurement from a temperature sensor operatively coupled to a lighting unit and an ambient temperature measurement from a common temperature sensor.

In some embodiments, one or more computing elements are used to calculate the derived operating parameters from the detected operating parameters. For example, the computing elements may be used to provide a derived operating parameter obtained from one or more detected operating parameters using an empirical formula.

In some embodiments, the detection module includes a feedback circuit. In some embodiments of the invention, a feedback circuit can be configured to capture one or more current operating conditions of the lighting unit, and correlate these operating conditions with one or more previously captured operating conditions. For example, this correlation between one or more current and past operating conditions can provide a means to determine if the operation of a particular component of the lighting module is diverging from normal. For example, it is know that over time, the luminous flux output of an LED decays, and thus a feedback circuit can be configured to evaluate if the decay of an LED is within the normal range or if it diverges from the normal range.

Signal Generating Module

The signal generating module receives information regarding the detected and/or derived operating parameters of a lighting unit, from the detection module and/or controller of the lighting unit and/or other sources (e.g. common sensors). In some embodiments, the signal generating module may be configured to obtain one or more derived operating parameters from the one or more detected operating parameters.

The signal generating module generates a desired warning signal if one or more operating parameters are determined to be abnormal, wherein the warning signal is indicative of the abnormal operating parameter or a known combination of abnormal operating parameters. An abnormal operating parameter may be, for example, an excessive temperature, a low light output, a high drive current, a high drive voltage or the like.

The desired warning signal generated by the signal generating module is selected from a plurality of warning signals. Each of said plurality of warning signals indicates a specific abnormal operating parameter or a known combination of specific abnormal operating parameters. Thus, the desired warning signal that is generated by the signal generating module depends on the type of abnormality detected, and allows a user to choose an appropriate remedial action.

The determination of abnormality in the detected and/or derived operating parameters may be achieved in different ways. In some embodiments, an operating parameter is determined to be an abnormal operating parameter when it falls outside a pre-determined range. This pre-determined normal range may be programmable, for at least one or more of the operating parameters.

In some embodiments, an operating parameter is determined to be an abnormal operating parameter only when it falls outside a pre-determined range, a pre-determined number of instances. The pre-determined number of instances may be different for each operating parameter and/or known combination of specific operating parameters. An exemplary coding scheme is shown in Table 1 below, for a scenario where the coded warning system detects the drive current of the light source(s) within the lighting unit, and the drive current of a fan used for active cooling. As defined for this example, no signal is generated when the drive currents of both the light source(s) and the fan are low; however, when either or both of the drive currents are determined to be abnormal (e.g. high), an appropriate desired warning signal is chosen from the plurality of warning signals (S0, S1, S2), as per the coding scheme of Table 1.

TABLE 1

| Drive Current of Light Sources; Drive Current of Fan | Desired Warning Signal Generated |
|---|---|
| Low; Low | N/A |
| High; Low | S0 |
| Low; High | S1 |
| High; High | S2 |

A user may be able to choose an appropriate remedial action, based on the warning signal generated. For example, the user may replace the light source(s) when S0 is generated; replace the fan when S1 is generated; and replace the entire lighting unit when S2 is generated.

A worker skilled in the art will readily understand that the coding scheme may be more complex, for more complex lighting units that require detection of a larger number of operating parameters. The number of the plurality of warning signals used by the coding scheme depends on the number of specific abnormal operating parameters and the number of known combinations of specific abnormal operating parameters that the user would like the coded warning system to indicate. Thus, the coding scheme uses a one-to-one mapping scheme between the desired warning signal generated and the specific abnormal operating parameter and/or known combination of specific abnormal operating parameters.

The coding scheme may be implemented by the signal generating modules using a look-up table stored in an associated memory, or may be hard-wired. The coding scheme may be programmable, for example, by allowing the user to modify a look-up table.

In some embodiments, the warning signals may be programmed to escalate based on the time lapsed since the first instance of signalling. For example, a series of five blinks may indicate a high drive current for the light source(s), and may escalate to a series of ten blinks if a remedial attention is not performed for a pre-determined period of time.

Each of the plurality of warning signals used in the coding scheme can be communicated to a user in a different manner, for example, by means of visual, audible, electronic indicators. Each of the warning signals may also be communicated via a combination of one or more component signals of different types. For example, the warning signal S2 of the coding scheme of Table 1, may have both a visual component and an audible component, while the warning signal S1 may have only a visual component.

In some embodiments, the separate components of a warning signal may be related. In some embodiments, a one-to-one mapping exists between an electronic component and an audible component of the warning signal. For example, the electronic component may be used to create the audible component, resulting in one-to-one mapping there-between. In one embodiment, a first warning signal utilizes five blinks as its visual component, and five beeps as its audible component; while a second warning signal utilizes ten blinks as its visual component and ten beeps as its audible component.

In some embodiments, each of the plurality of warning signals may comprise a unique visual component but share a common audible component (e.g. a loud beep). For example, the common audible component alerts a user about the existence of an abnormality in the operation of the lighting unit, while the unique visual component would indicate, to an interested user, the specific abnormal operating parameter or known combination of abnormal operating parameters detected. Thus, the mapping between the visual component and the audible component is many-to-one.

In some embodiments, each of the plurality of warning signals is electronic, and the generated desired warning signal is used to create a visual warning indicator, such as a lighting effect, and/or an audible warning indicator. For example, a visual warning indicator may be obtained by using an electronic desired warning signal to drive one or more light sources in a particular manner to generate, for example, one or more blinks; one or more momentary intensity drops; a temporary color change; a series of color changes; variations of light output based on different time scales, time durations, intensities and/or colors; and one or more combinations thereof.

Figure 4A:
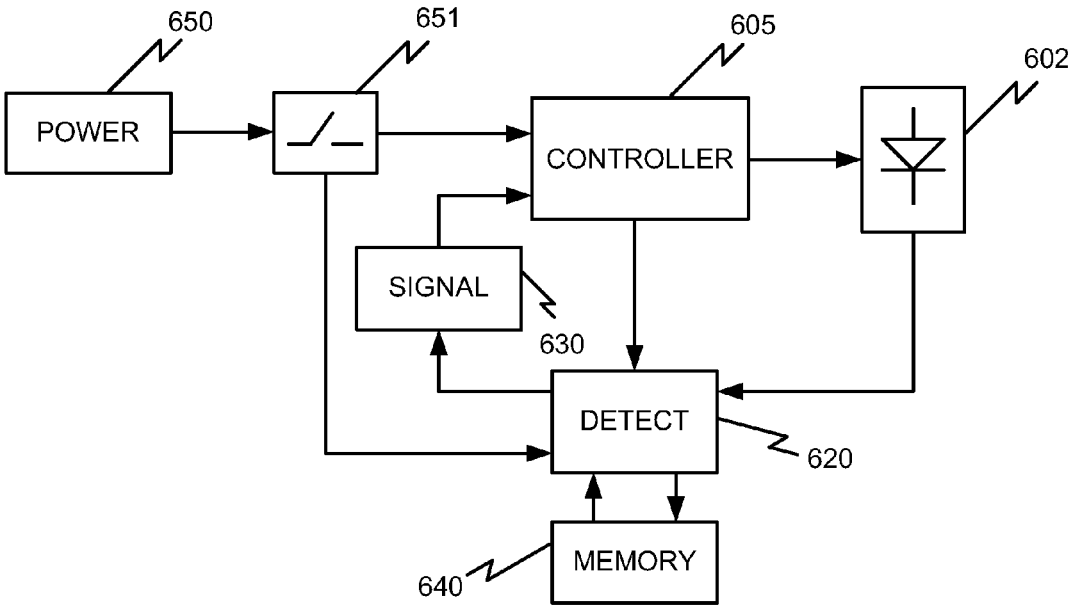
FIGS. 4A-B illustrate lighting units according to embodiments of the invention, wherein the desired warning signal is used by the controller of the lighting unit to create a visual warning indicator, using its light source(s).
Figure 4B:
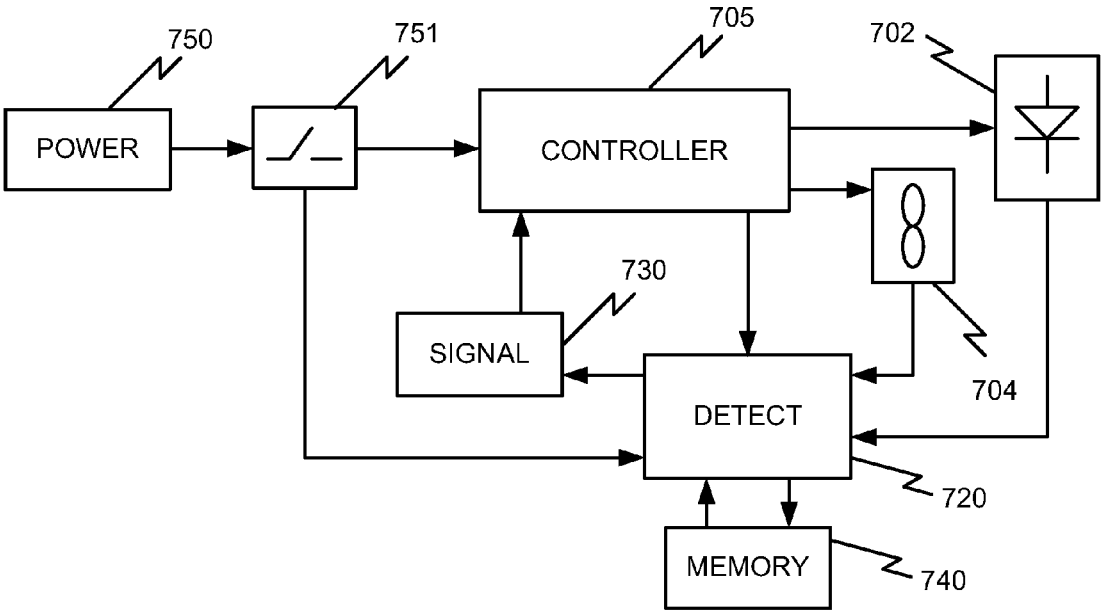

The light source(s) used to create a visual warning indicator may be external to the lighting unit (e.g. a separate indicator lamp) or, preferably, may be at least one of the light source(s) of the lighting unit. In some embodiments, and referring to FIGS. 4A-4B, the desired warning signal is generated by the signal generating module 630, 730 based on information received from the detection module 620, 720 and/or memory 640, 740. The desired warning signal is transmitted, via a communication link (as would be readily known to a worker skilled in the art), to the controller 605, 705 of the lighting unit to drive at least one of the light source(s) 602, 702 to create the visual warning indicator, for example, a particular lighting effect corresponding to the desired warning signal. The lighting unit thus uses its own light source(s) to communicate the warning signal to a user. As the desired warning signal is indicative of the specific abnormal condition detected, the resulting visual warning indicator is also indicative of the specific abnormal condition detected. For example, a series of red flashes could signify that the light source(s) are almost burned out and therefore require replacement, while a blue flashing signal could indicate that the cooling system requires remedial attention. In the embodiments of FIGS. 4A-B, the lighting unit and the coded warning system share a common power source 650, 750 and a common switching element 651, 751.

In some embodiments, an electronic desired warning signal may also be used to create an audible warning indicator.

In embodiments of the invention, the desired warning signal may be transmitted from the signal generating module to a central monitoring device that is used to monitor a plurality of lighting units. An identification tag may be associated with the desired warning signal to enable easy identification of the corresponding lighting unit at the central monitoring device.

A worker skilled in the art will readily understand that the delay between the detection of the operating parameters and the generation of the desired warning signal depends on the design of the coded warning system. A memory-based (as opposed to real-time processing-based) design of the coded warning system may allow for programming the above-mentioned delay.

A single signal generating module may be shared by multiple lighting units. In one embodiment, a plurality of lighting units, each of which is operatively associated with a dedicated detection module, utilizes a common signal generating module. The common signal generating module receives information regarding the operating parameters from each of the dedicated detection modules. In one embodiment, a common signal generating module is shared by the multiple lighting units in a time-shared fashion.

In one embodiment, the detection module and the signal generating module may be integrated into a single module. In one embodiment, the detection module and/or the signal generating module may be integrated with the controller of the lighting unit. A microprocessor may be used in the detection and/or signal generating modules. As solid state lighting-based lighting units typically use controllers, it may be suitable to modify the electronic circuitry or firmware of the controller to incorporate the extra functionality of a coded warning system therein.

In some embodiments, a single coded warning system is shared by multiple lighting units in a time-shared fashion. For example, the desired warning signal may be generated at substantially switch-on or substantially switch-off of the lighting unit. In one embodiment, the desired warning signal is generated within a second or so of the lighting unit being switched on or switched off. The coordination of the signalling with the activation or deactivation of the lighting unit may increase the likelihood that a user made aware of imminent failure of the lighting unit (e.g. due to his/her likely close proximity). Appropriate means may be incorporated in the coded warning system and/or lighting unit to ensure that sufficient power is stored for signalling at switch-off.

The functionality of determining if one or more operating parameters are abnormal operating parameters may be achieved by the detection module and/or the signal generating module.

Memory

Figure 3A:
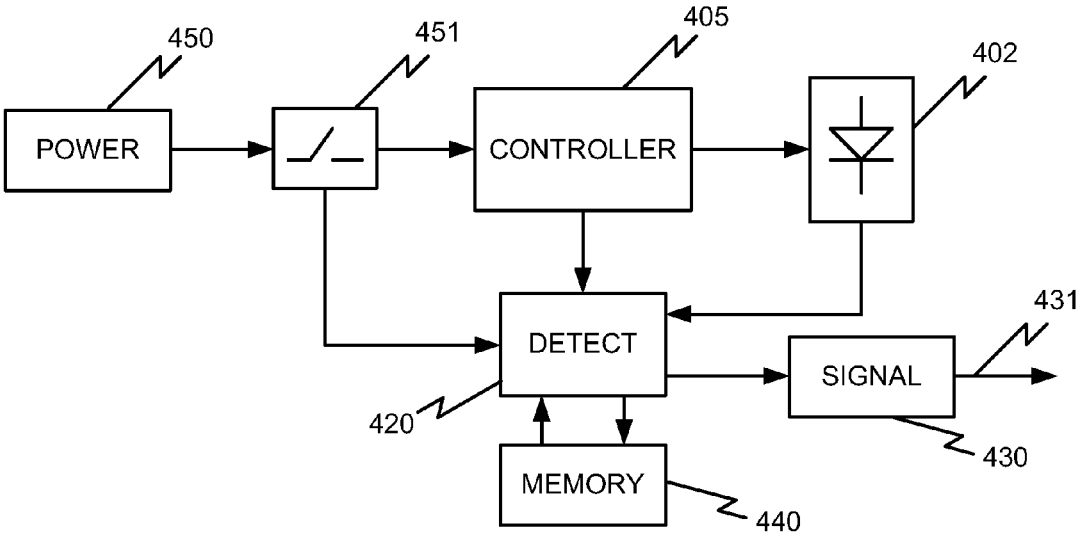
FIGS. 3A-B illustrate lighting units, according to embodiments of the invention, which are operatively associated with a coded warning system, wherein the coded warning system uses an electronic memory for storage of information relating to detected abnormalities in the operation of the light source.
Figure 3B:
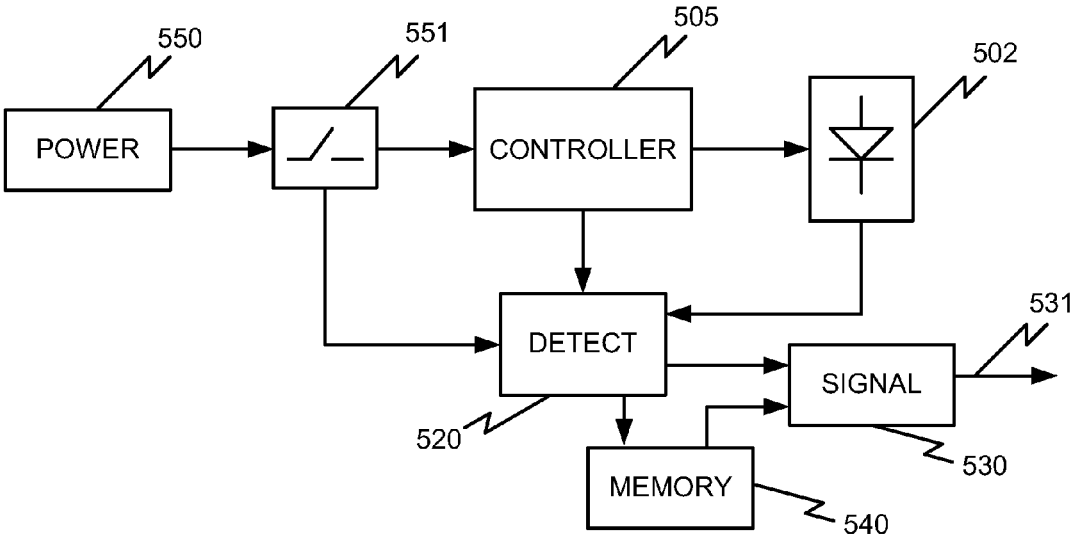

Referring to FIGS. 3A-B, in some embodiments, the coded warning system includes a memory 440, 540, as defined above, to store information regarding the detected and/or derived operating parameters. The coded warning system is operatively associated with a lighting unit comprising a light source 402, 502 and a controller 405, 505, and may share a common power source 450, 550 using a common switching element 451, 551. The contents of the electronic memory 440, 540 are also taken into account in generating the desired warning signal 431, 531. The contents of the electronic memory 440, 540 may be accessed by the signal generating module 430, 530 either indirectly via the detection module 420 (FIG. 3A) or directly (FIG. 3B) without utilizing the detection module 420. In one embodiment, the detection module determines whether an operating parameter is abnormal and the memory stores the fact that an operating parameter has been determined to be abnormal. In embodiments, the memory stores all the detected operating parameters for later determination of abnormality by the detection module and/or the signal generating module. A memory-based coded warning system may be configured to introduce a delay between the generation of the desired warning signal and the detection of the operating parameters.

Figure 5:
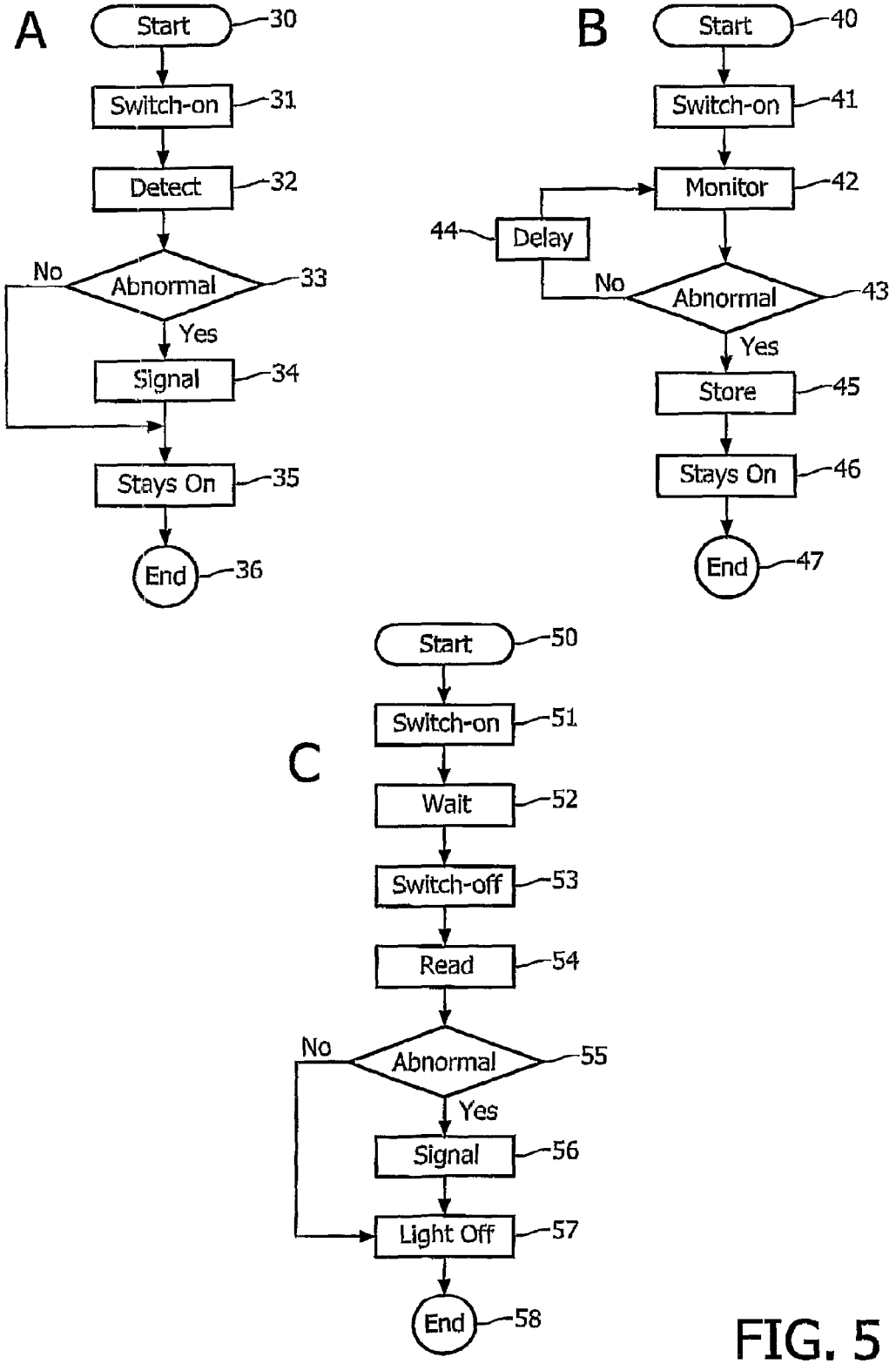
FIGS. 5A-C illustrate various flow diagrams for the operation of the coded warning system, according to embodiments of the invention.

FIGS. 5A-5C show various flow diagrams for the operation of the coded warning system with an operatively associated lighting unit. In one exemplary process shown in FIG. 5A, the lighting unit is switched on 31 and its operating condition detected 32. If there is an abnormal condition 33, a corresponding warning signal 34 indicative of that abnormal condition is generated, following which the lighting unit stays on 35 as intended by the user's action of switching it on. If there is no abnormal condition 33, no warning signals are generated and the light stays on 35 as intended.

In one configuration shown in FIG. 5B, an abnormal condition is stored in the memory. The lighting unit is switched on 41, and the detection module obtains information 42 regarding the operating conditions of the light source(s) and/or the controller while the lighting unit is on. If an abnormal condition is detected 43, it is stored 45 in the memory after which the light stays on 46 as desired. Otherwise, the detection module continues to monitor the operating conditions, either continuously or intermittently after a delay 44.

FIG. 5C shows a flow diagram, where the detection module reads an abnormal condition from the memory and signals at switch off. The lighting unit is switched on 51 and left on for the desired period 52. At switch off 53, the detection module reads 54 the memory and if there is an abnormal condition 55 it generates a signal 56 which is indicative of the specific abnormal condition before the light is turned off completely 57. If there is no abnormal condition 55, no signaling is done. A worker skilled in the art will readily understand that to allow for signaling at switch off, adequate energy must be stored in the various modules, and will readily know appropriate designs for the same.

In some embodiments, the lighting unit may be configured to be overridden by a safety circuit. For example, if a hazardous condition is detected then a safety circuit would switch off the lighting unit. However, if a potentially hazardous condition is detected, the coded warning system may be able to generate a signal indicative of the hazardous condition before the lighting unit is switched off completely, or may be able to store an indication of the hazardous condition in the memory. At a following switch on, the coded warning system may be able to generate a signal representative of the hazardous condition after which the lighting unit will be switched off by the safety circuit. Such a hazardous condition may be an unusually high temperature, for example.

Due to aging, and in simple lighting unit designs with no feedback loop, the light output may fall so gradually that it is difficult to perceive. A gradual decrease in light output is also possible in lighting units with feedback, where the controller is operating at its limit due to the age of the light source(s). In one exemplary configuration of the coded warning system, the detection module is configured to obtain information regarding the light output of the light source(s). When the light intensity is below a predetermined first threshold, a first warning signal is generated by the signal generating module, which is used by the controller to generate a first visual warning indicator: e.g. a momentary dimming of the light output after switch on. This visual warning indicator indicates to the user that the lighting unit should soon be replaced. Optionally, once the light intensity is below a predetermined second threshold, a different warning signal may be generated, resulting in a second visual warning indicator: e.g. momentary switching off of the light following switch on.

In another example configuration of a coded warning system, the detection module detects the hours of operation of the lighting unit, the drive current and the operating temperature of the light source(s). If the temperature is high and the operating hours are low, a first warning signal is generated to indicate an unsuitable installation, e.g. a newly installed light source in a poorly ventilated location. If the temperature is high, the hours are not very low and the drive current is normal, a second warning signal is generated to indicate that the lighting unit needs cleaning, for example, by the removal of a dust build up in the fins of the heat sink. If the temperature, drive current and the hours are high, a third warning signal is generated to indicate that the light source(s) and/or the entire lighting unit should soon be replaced.

EXAMPLE 1

Figure 6:
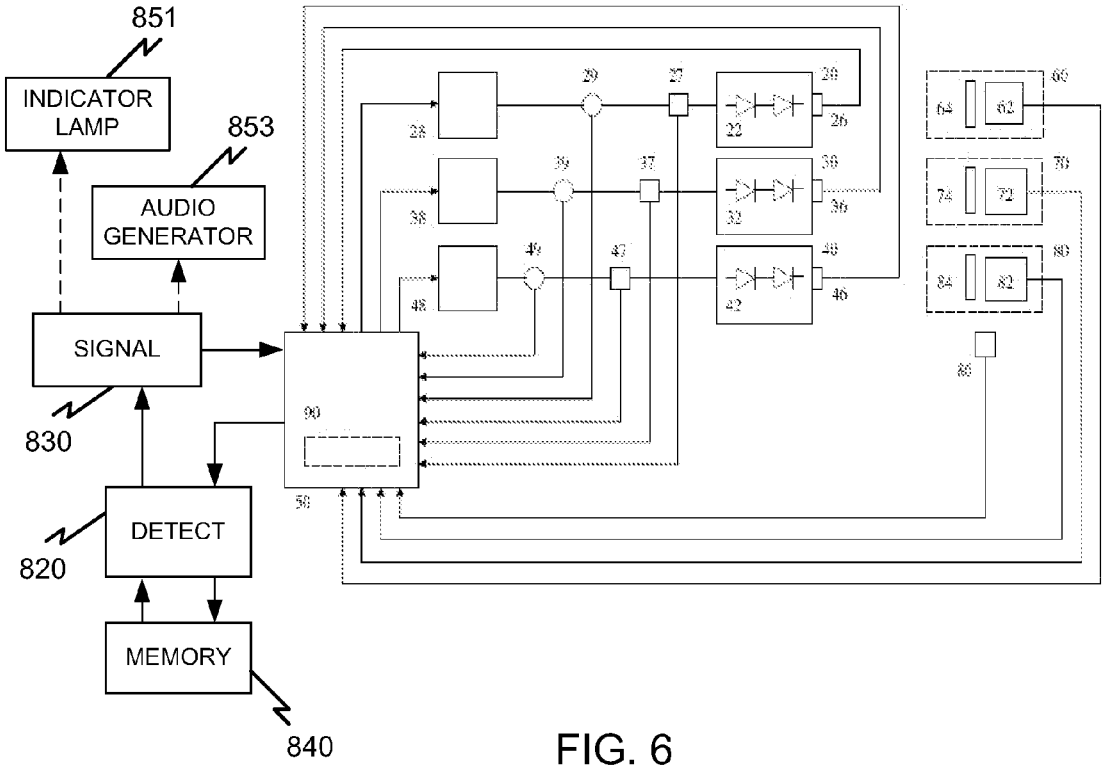
FIG. 6 shows the schematic of a lighting unit with a coded warning system, in accordance with an embodiment of the invention.

FIG. 6 illustrates a block diagram of an exemplary lighting unit operatively associated with a coded warning system of the invention. The lighting unit includes arrays 20, 30, 40 each having a plurality of LED-based light sources that are in thermal contact with one or more heat sinks or thermal management systems (not shown). In an embodiment, the red light sources 22, green light sources 32, and blue light sources 42 in arrays 20, 30, 40 can be mounted on separate heat sinks. The combination of colored light generated by each of the red light sources 22, green light sources 32 and blue light sources 42 can generate light of a specific chromaticity, for instance white light. In one embodiment, the lighting unit includes mixing optics (not shown) to spatially homogenize the output light generated by mixing light from the red light sources 22, green light sources 32, and blue light sources 42.

Current drivers 28, 38, 48 are coupled to arrays 20, 30, 40, respectively, and are configured to supply current to the red light sources 22, green light sources 32, and blue light sources 42 in arrays 20, 30, 40. The current drivers 28, 38, 48 control the luminous flux outputs of the red light sources 22, green light sources 32, and blue light sources 42 by regulating the flow of current through the red light sources 22, green light sources 32, and blue light sources 42. The current drivers 28, 38, 48 can be configured to regulate the supply of current to arrays 20, 30, 40 independently, interdependently and/or dependently so as to control the chromaticity of the combined light as described hereinafter.

In an embodiment, the current drivers 28, 38 and 48 can use pulse width modulation (PWM) technique for controlling the luminous flux outputs of the red light sources 22, green light sources 32, and blue light sources 42. Since the average output current to the red light sources, green light sources, or blue light sources is proportional to the duty factor of the PWM control signal, it is possible to dim the output light generated by the red light source, green light sources, or blue light sources by adjusting the duty factors for each array 20, 30 and 40, respectively. The frequency of the PWM control signal for the red light sources, green light sources, or blue light sources can be chosen such that the human eye perceives the light output as being constant rather than a series of light pulses, for example a frequency greater than about 60 Hz. In an alternative embodiment, the current drivers 28, 38, 48 are controlled with pulse code modulation (PCM), or other digital format as known in the art.

Current sensors 29, 39, 49 are coupled to the output of current drivers 28, 38, 48 and measure the instantaneous forward current supplied to the light source arrays 20, 30, 40. The current sensors are optionally a fixed resistor, a variable resistor, an inductor, a Hall effect current sensor, or other element which has a known voltage-current relationship and can provide a measurement of the current flowing through the load, for example an array of one or more light sources, based on a measured voltage signal. In an alternative embodiment, the peak forward currents for each array 20, 30, or 40 can be fixed to a pre-set value to avoid measuring both the forward and instantaneous current supplied to arrays 20, 30, 40 at a given time.

A controller 50 is coupled to current drivers 28, 38, 48. The controller 50 is configured to adjust the amount of average forward current by adjusting the duty cycle of the current drivers, thereby providing control of the luminous flux output. The controller can also be coupled to current sensors 29, 39, 49 and can be configured to monitor the instantaneous forward current supplied to the arrays 20, 30, 40 as provided by the current drivers.

In one embodiment, voltage sensors 27, 37, 47 are coupled to the output of current drivers 28, 38, 48 and measure the instantaneous forward voltage of light source arrays 20, 30, 40. Controller 50 is coupled to voltage sensors and configured to monitor the instantaneous forward voltage of light source arrays. Because the junction temperature of a light source substantially nonlinearly depends on the drive current, it is possible to determine the light source junction temperature by measuring the light source forward voltage, for example.

The lighting unit further includes optical sensor systems 60, 70, 80 which can be operatively coupled to a proportional-integral-derivative (PID) feedback loop configuration with PID controller 90 that can be embedded in controller 50 in firmware. Alternatively, the PID controller can be a separate component operatively connected to the controller.

Each optical sensor system 60, 70, 80 generates a signal representative of the average spectral radiant flux from arrays 20, 30, 40. Each optical sensor system includes, for example, optical sensors 62, 72, 82, which can be for example a photodiode, responsive to spectral radiant flux emitted by the arrays. In one embodiment, each optical sensor can be configured to be sensitive to light of a narrow wavelength regime. Advantageously, red, green and blue optical sensors can be used to measure the contribution from red light sources 22, green light sources 32 and blue light sources 42, respectively. Optionally, each optical sensor may be equipped with a filter 64, 74, 84 that can limit the wavelength(s) of light that are incident on their respective optical sensor. For example, when a particular optical sensor is desired to capture only a specific wavelength range, which may be a subset of the wavelength range to which the optical sensor is responsive, an optical filter associated with that optical sensor can provide limit the incident wavelengths to a desired range. The optical filters can be thin film interference, dyed plastic, dyed glass or the like. It is understood that a number of types of optical sensors can be used, for example photodiodes, phototransistors, photosensor integrated circuits (ICs), unenergized LEDs, and the like.

One or more temperature sensors 26, 36, 46 in thermal contact with the one or more heat sinks, and coupled to controller 50 can be provided to measure the temperature of the arrays. The temperature of the arrays can be correlated to the junction temperature of red light sources 22, green light sources 32 and blue light sources 42.

In one embodiment, red light sources 22, green light sources 32, and blue light sources 42 can be mounted on separate heat sinks or other thermal management systems with separate temperature sensors thermally connected thereto. It is understood that the red light sources, green light sources, and blue light sources can also be mounted on a single heat sink, whereby at least one temperature sensor would be needed to determine the junction temperature of the red light sources, green light sources, and blue light sources. In another embodiment, the temperature sensors 26, 36, 46 are placed proximate to each light source array 20, 30, or 40 to provide a more accurate value of the junction temperature of the red light sources, green light sources and blue light sources, respectively. It is noted that the red light sources, green light sources and blue light sources are likely pulsed at a rate much higher than the thermal time constant of the one or more heat sinks and therefore the temperature sensor will therefore likely observe an average heat load.

In one embodiment, temperature sensors 26, 36, 46 can be implemented using a thermistor, thermocouple, light-emitting element forward voltage measurement, integrated temperature sensing circuits, or any other device or method that is responsive to variations in temperature as contemplated by those skilled in the art.

The controller 50 is operatively associated with a coded warning system of the invention. The coded warning system includes a detection module 820 which is configured to obtain information regarding one or more operating parameters of the lighting unit from the controller. The detection module 820 obtains information from the controller regarding the measurements of the current sensors 29, 39, 49, the voltage sensors 27, 37, 47, the temperature sensors 26, 36, 46, and the optical sensor systems 60, 70, 80. The detection module may optionally also obtain information regarding one or more operating parameters of the lighting unit from additional sensors (not shown) that may be external or internal to the lighting unit. In addition, the detection module also obtains information from the controller regarding divide by zero errors in firmware, firmware bugs or other errors as would be readily known to a worker skilled in the art, encountered therein.

A memory-based configuration is used for the coded warning system, which allows for recording information regarding the one or more detected operating parameters of the lighting unit on an electronic memory 840 that is operatively associated with the detection module 820. The recorded information on the electronic memory thus includes information regarding the measurements of the current sensors 29, 39, 49, the voltage sensors 27, 37, 47, the temperature sensors 26, 36, 46, and the optical sensor systems 60, 70, 80, and the controller.

The recorded information is accessed, at least in part, by the signal generating module 830 via the detection module 820 for generating a desired warning signal selected from a plurality of warning signals. Each warning signal of the plurality of warning signals is indicative of a specific abnormal operating parameter or a known combination of specific abnormal operating parameters. The memory-based configuration entails that the generation of the desired warning signal by the signal generating module and the reception of information regarding the detected operating parameters by the detection module may occur at different instants. In one embodiment, the information regarding the detection of the operating parameters occurs continually while the lighting unit is switched on, while the desired warning signal is generated only when the lighting unit is switched on.

The desired warning signal generated by the signal generating module 830 is sent to the controller 50 and is used by the controller 50 to determine the settings of the current drivers 28, 38, 48 and thus control the light output of the red light sources, green light sources and blue light sources, respectively, to create a visual warning indicator. The visual warning indicator thus created is indicative of the specific abnormal operating parameter or a known combination of specific abnormal operating parameters.

The desired warning signal generated by the signal generating module 830 may also be used optionally (as shown by the dotted lines) to drive a separate light source (e.g. an indicator lamp 851) to create a visual warning indicator; and/or be used to drive an audio generator 853 to create an audible warning indicator.

EXAMPLE 2

Figure 7:
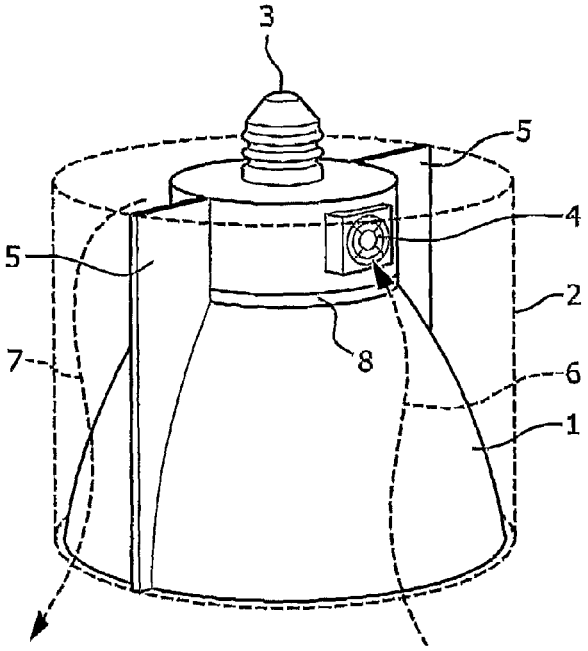
FIG. 7 illustrates a lighting unit with a removable fan module and coded warning system according to one embodiment of the invention.
Figure 8A:
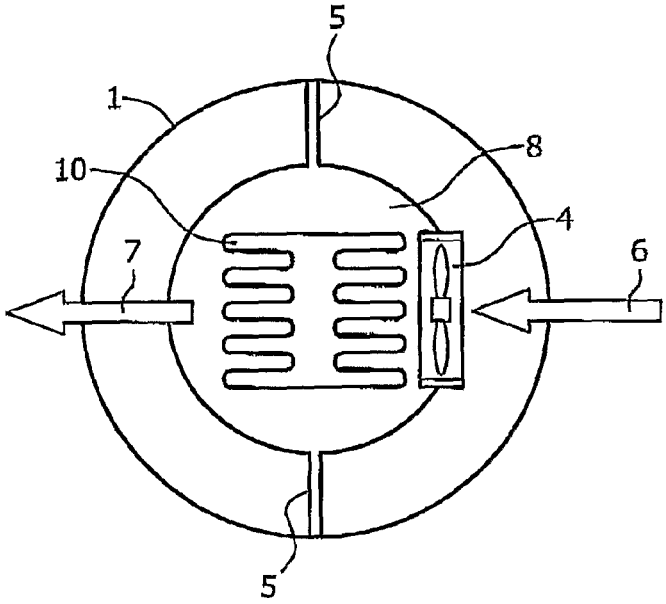
FIG. 8A illustrates sectional view from above of the lighting unit of FIG. 7.

Referring to FIG. 7, an exemplary lighting unit 1 with a removable fan module is shown. The lighting unit 1 is intended to be mounted in a ceiling recess of approximate outline 2, by way of a screw type fixing 3. A fan 4 is removably positioned on a circuit board 8 configured to act as a controller for the lighting unit, in the upper part of the lighting unit. When driven, the fan 4 rotates to draw air into it along path 6, between the sidewall of the lighting unit 1 and the recess 2. Air leaves the upper part of the lighting unit along path 7 between the opposite sidewall of the lighting unit 1 and the recess 2. Baffles 5 can ensure that the air flow is substantially from one side of the lighting unit 1 to the other, rather than circulating in the upper volume of the recess 2. Referring to FIG. 8A (a sectional view from above), the air flow 6, 7 passes over a heat sink mounted on the circuit board 8, and removes waste heat there-from.

Figure 8B:
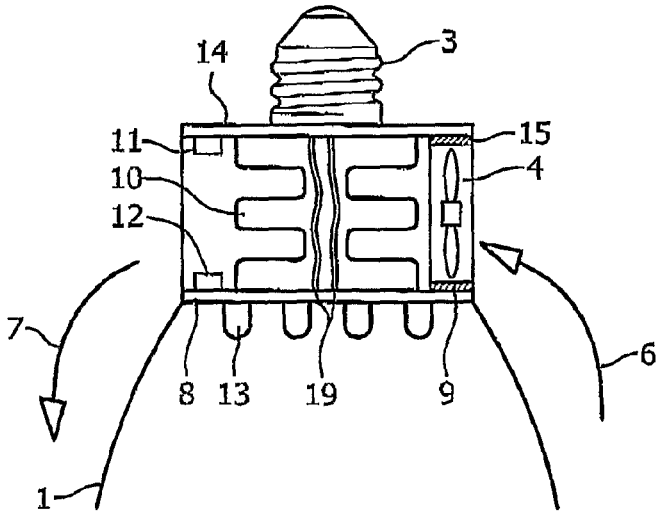
FIG. 8B illustrates a sectional view from the side of the lighting unit of FIG. 7.

FIG. 8B shows a section of the lighting unit 1 as viewed from the side. Fan 4 is mechanically located in position in mounts 9 and/or 15. Either of these mounts may also provide an electrical connection to the fan. Base 14 may also be a circuit board, and may be connected to circuit board 8 with wires 19. Additional components 11, 12 may be mounted on the boards 14 and 8. Light sources 13 are mounted on the underside of board 8.

Figure 9A:
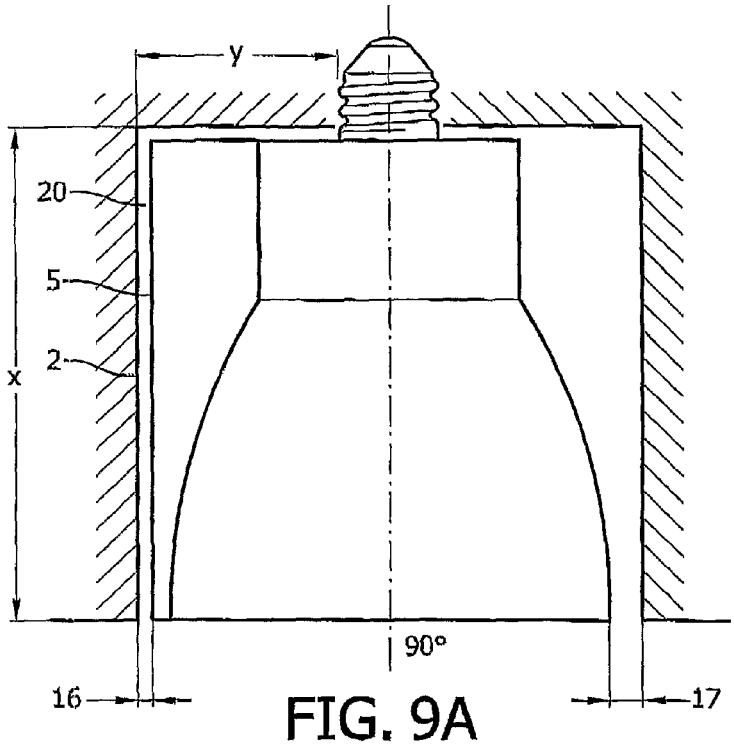
FIG. 9A illustrates a half sectional views taken 90° from each other of the lighting unit of FIG. 7.
Figure 9B:
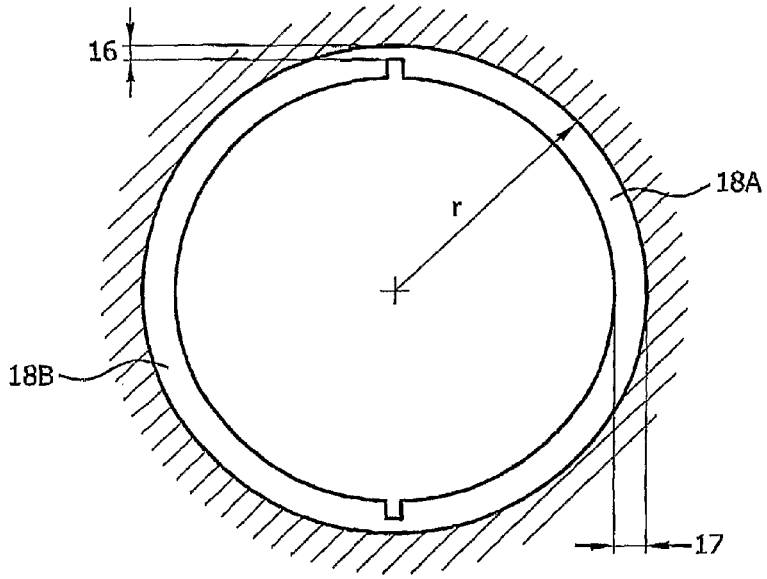
FIG. 9B illustrates a sectional view from below of the lighting unit of FIG. 7.

FIG. 9A shows half sections of the lighting unit 1 taken 90° from each other. In order to attempt to optimize air flow, the gap between the baffles 5 and the recess 2 should be significantly smaller than the gap between the rim of the lighting unit and the sidewall 17. More specifically, the area 20 of gap 16 multiplied by length (x+y) should be significantly less than the area 18A or 18B in FIG. 9B found by multiplying the gap 17 by length $\pi r$. The shape of the baffles 5 should conform substantially to the shape of the recess.

The fan may be a variable speed fan. The fan may have a boost speed, which increases the air flow by several times in order to dislodge some of the dust on an occasional basis, or as and when cooling efficiency indicates necessary. The fan could have a reverse flow mode, also to help dislodge dust on an occasional basis.

The fan may be replaced when it is dusty, or when there is so much dust build up that the fan will not rotate on applying a voltage, or when the cooling system has become generally inefficient due to dust. A user may remove the lighting unit from its mount, remove the fan to clean or replace it. Dust from around the heat sink and other air paths may also be cleaned. However, it is not easy even for an interested observer to know if the lighting unit is dim because the LEDs are at the end of their useful life or because in-built temperature controls are causing the LEDs to be driven below ideal conditions due to an inefficient, dusty cooling system.

Therefore, the lighting unit is operatively associated with a coded warning system wherein the detection module detects the rate of cooling of the lighting unit and a drive current for the fan module. Rate of cooling may be measured by monitoring the temperature of the LEDs or the heat sink, for example, over a period of time following switch on of the lighting unit. The ambient temperature may also be taken into account, for example, by relative measurement thereof.

If the rate of cooling is too slow, for example due to dust build up, the signal generating module generates a first warning signal. This condition may be stored in an electronic memory and signaled either at switch off and/or subsequent switch-on. If the detection module detects too high a fan current, indicating that the fan may not be rotating, the signal generating module generates a second warning signal at switch on/off and/or on the first occasion the fan ceases to turn. The lighting unit may optionally be configured to automatically shut off, or be left on such that the LEDs are operating at a low enough intensity that operation of the fan is not required.

While several inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

What is claimed is:

1. A coded warning system for a lighting unit comprising one or more LED-based light sources configured to emit light, said system comprising:

a detection module configured to obtain information regarding a plurality of operating parameters of said lighting unit; and a signal generating module configured to generate a desired warning signal selected from a plurality of warning signals, upon determination that one or more of the operating parameters are abnormal operating parameters, wherein the warning signal generated depends on the type of abnormality detected, the signal generating module further configured to communicate the generated warning signal to a central monitoring device, wherein the communicated signal comprises an identification tag specific to the lighting unit;

wherein each warning signal of the plurality of warning signals is indicative of both: (i) a specific abnormal operating parameter or a known combination of specific abnormal operating parameters; and (ii) a remedial action responsive to the specific abnormal operating parameter or the known combination of specific abnormal operating parameters.

2. The coded warning system of claim 1, wherein an operating parameter is determined to be an abnormal operating parameter when it falls outside a pre-determined range for said operating parameter.

3. The coded warning system of claim 1, wherein an operating parameter is determined to be an abnormal operating parameter only when it falls outside a pre-determined range for said operating parameter a pre-determined number of instances.

4. The coded warning system of claim 1, wherein said desired warning signal is communicated to a user via a warning indicator corresponding to said warning signal.

5. The coded warning system of claim 4, wherein said warning indicator is a lighting effect generated by at least one of said light sources.

6. The coded warning system of claim 4, wherein said lighting effect is selected from the group consisting of: one or more blinks; one or more momentary intensity drops; a temporary color change; a series of color changes; and variations of light output based on different time scales, time durations, intensities and/or colors.

7. The coded warning system of claim 1, wherein said desired warning signal is generated at substantially switch-on or substantially switch-off of said lighting unit.

8. The coded warning system of claim 7, wherein the one or more operating parameters are detected at substantially switch-on or substantially switch-off of said lighting unit.

9. The coded warning system of claim 7, wherein said one or more operating parameters are detected continually or periodically while said lighting unit is switched on.

10. The coded warning system of claim 1, wherein said coded warning system comprises an electronic memory for recording information regarding the one or more operating parameters detected, said information at least in part used for generating said desired warning signal.

11. The coded warning system of claim 1, wherein said one or more operating parameters are selected from the group consisting of: temperature, light output, drive current, drive voltage, change in temperature, rate of change of temperature, and time of operation of said light sources; speed and drive current of a fan used for active cooling of said lighting unit, ambient temperature, sensor failure, hardware failure or problems, firmware bugs, divide by zero errors in firmware, and faulty string in a multiple string lighting unit.

12. The coded warning system of claim 1, wherein said detection module and said signal generating module are integrated in a single module.

13. A lighting unit configured to communicate abnormalities in its operation to a user via a lighting effect, said lighting unit comprising:

one or more LED-based light sources configured to emit light;

a controller configured to drive at least one of said one or more LED-based light sources;

a detection module configured to obtain information regarding a plurality of operating parameters of said lighting unit; and a signal generating module configured to generate a desired warning signal selected from a plurality of warning signals, upon determination that one or more of the operating parameters are abnormal operating parameters, wherein the warning signal generated depends on the type of abnormality detected, the signal generating module further configured to communicate the generated warning signal to a central monitoring device, wherein the communicated signal comprises an identification tag specific to the lighting unit;

wherein each warning signal of the plurality of warning signals is indicative of both: (i) a specific abnormal operating parameter or a known combination of specific abnormal operating parameters; and (ii) a remedial action responsive to the specific abnormal operating parameter or the known combination of specific abnormal operating parameters, and wherein said controller is further configured to drive at least one of said light sources in response to said desired warning signal to generate the lighting effect corresponding thereto.

14. The lighting unit of claim 13, wherein said lighting effect is selected from the group consisting of: one or more blinks; one or more momentary intensity drops; a temporary color change; a series of color changes; and variations of light output based on different time scales, time durations, intensities and/or colors.

15. The lighting unit of claim 13, wherein said lighting unit is configured for mounting in a cylindrical recess, and further comprises:

a heat sink operatively associated with said controller;

a removable fan configured to draw air proximal to said heat sink to remove waste heat there-from; and, one or more baffles operatively attached to an external side of a housing of said lighting unit for enhanced circulation of air and thus, removal of said waste heat.

16. The lighting unit of claim 15, wherein a gap between said baffles and the cylindrical recess is smaller than the gap between the rim of the housing of lighting unit and the sidewall of the cylindrical recess.

17. A method of indicating abnormalities in the operation of a lighting unit comprising one or more light sources configured to emit light, said method comprising:

obtaining information regarding a plurality of operating parameters of said lighting unit;

generating a desired warning signal selected from a plurality of warning signals, upon determination that one or more of the operating parameters are abnormal operating parameters, wherein the warning signal generated depends on the type of abnormality detected; and communicating the generated warning signal to a central monitoring device, wherein the communicated signal comprises an identification tag specific to the lighting unit;

wherein each warning signal of the plurality of warning signals is indicative of both: (i) a specific abnormal operating parameter or a known combination of specific abnormal operating parameters; and (ii) a remedial action responsive to the specific abnormal operating parameter or the known combination of specific abnormal operating parameters.

18. The method of claim 17, further comprising generating a lighting effect by said one or more light sources corresponding to said desired warning signal.

* * * * *